United States Patent [19]

Heisey

[11] 4,130,790

[45] Dec. 19, 1978

[54] FERRORESONANT TRANSFORMER POWER SUPPLY

[75] Inventor: Larry E. Heisey, Troy, Ohio

[73] Assignee: Hobart Brothers Company, Troy, Ohio

[21] Appl. No.: 790,409

[22] Filed: Apr. 25, 1977

[51] Int. Cl.[2] ..... G05F 1/32

[52] U.S. Cl. ..... 323/60; 363/75; 363/91

[58] Field of Search ..... 323/60, 61, 6; 363/75, 363/91, 92, 93, 126

[56] References Cited

U.S. PATENT DOCUMENTS

| | | | |
|---|---|---|---|
| 3,037,159 | 5/1962 | Brown | 363/93 |
| 3,054,939 | 9/1962 | Thompson | 363/75 |
| 3,112,439 | 11/1963 | Rosin | 323/60 |
| 3,239,750 | 3/1966 | Weber | 323/61 |
| 3,371,263 | 2/1968 | Walz et al. | 323/61 |
| 3,440,516 | 4/1969 | Kaiser | 363/75 |
| 3,521,147 | 7/1970 | Ostreicher | 323/61 |
| 3,739,257 | 6/1973 | Hunter | 323/60 |
| 3,824,449 | 7/1974 | Hase | 323/60 |
| 3,914,685 | 10/1975 | Van Gilder | 323/61 |
| 4,004,209 | 1/1977 | Lawson, Jr. | 363/75 |

*Primary Examiner*—Gerald Goldberg
*Attorney, Agent, or Firm*—Biebel, French & Nauman

[57] ABSTRACT

An electrical power supply for providing an electrical power signal of substantially constant voltage when the current level of the power signal is less than a predetermined value and for reducing the voltage of the power signal below said predetermined level when the power signal current level exceeds the predetermined value includes a ferroresonant transformer. A saturable reactor provides a current responsive impedance connected to the primary of the ferroresonant transformer for reducing the voltage supplied to the primary winding. The maximum current level in the secondary circuit of the ferroresonant transformer is adjusted by adjusting the effective impedance of the saturable reactor. A rectifier may be connected in the secondary circuit of the ferroresonant transformer to provide direct current electrical power signal. Three phase power may be used as a power supply input with six ferroresonant transformers having three primary windings connected in delta and three primary windings connected in wye electrical configuration.

13 Claims, 7 Drawing Figures

153
155
157
119
167
181
183
131
143
217
227
229
173
193
195
125
149
137
159
161
163
107
109
223
121
169
185
187
133
145
219
127
175
197
199
151
139
239
225
245
241
243
K2a
OFF
K2b
237
ON
235
247
K2
G
231
233

FERRORESONANT TRANSFORMER POWER SUPPLY

BACKGROUND OF THE INVENTION

The present invention relates to electrical power supply circuits and, more particularly, to a power supply circuit which provides a substantially constant potential output signal but which limits the maximum output current to a predetermined current level.

There are many situations in which a high current power supply is required. Electrical power must be provided for powering various avionic systems when an airplane is on the ground with its engines off. Guidance, radio, radar, and other such systems require substantial power and it is highly desirable that this electrical power be carefully regulated. In aviation power systems operating on direct current, it is necessary to keep the ripple content of the power supply output at a minimum level to prevent interference with radio reception and with check out and operation of guidance systems.

Generally, electrical power for the engine starting motors is also provided by the same power supply. Since ground power supplies may be used with many different types of aircraft, it is desirable that such a power supply include a variable current limiting capability so that the maximum torque provided by the starting motors on various aircraft may be adjusted. If too great a starting current were permitted, the starting motors might provide a greater starting torque than can be tolerated and the aircraft might be damaged.

Engine generator sets cause substantial pollution and, therefore, are generally unacceptable as aviation ground power supplies inside a hanger or other enclosed structure. Motor generator sets powered by an electrical motor may be too noisy for some applications, such as check out of systems in an airplane assembly plant. Electrical-to-mechanical-to-electrical converters are also relatively inefficient at certain load levels. Various solid state AC-to-DC converters have in the past been used but these generally provide an undesirably high level of harmonic frequency superimposed on the DC output.

Thus it is seen that there is a need for a quiet, dependable static direct current power supply which provides an essentially ripple free output and which includes a means for limiting the maximum output current to a predetermined current level.

SUMMARY OF THE INVENTION

A power supply for converting an alternating current electrical power signal to a direct current electrical power signal in which the voltage of the direct current signal is maintained at a predetermined level when the current level of the direct current signal is less than a predetermined value. When the direct current level exceeds the predetermined value, however, the voltage of the direct current signal is reduced below said predetermined level.

The power supply includes a ferroresonant transformer having a primary circuit, which includes a primary winding wound on a primary core section, and a secondary circuit, which includes a secondary winding wound on a secondary core section. The primary and secondary core sections are connected by a shunt section which provides partial magnetic flux linkage between the core sections. The ferroresonant transformer will provide a substantially constant output voltage on a secondary circuit when the voltage on the primary winding is sufficient to maintain the secondary core section in magnetic flux saturation.

Rectifier means, connected to the secondary circuit of the ferroresonant transformer, rectifies the ferroresonant transformer and provides the desired direct current electrical power signal. An input terminal means is connected to an alternating current power source. A current responsive means, connected between the input terminal means and the primary circuit of the ferroresonant transformer, reduces the voltage supplied to the primary winding of the ferroresonant transformer in dependence upon the current therethrough. The current responsive means includes a means for adjusting the amount by which the primary winding voltage is reduced, whereby the current level in the secondary circuit which will be sufficient to prevent the secondary core section from being held in saturation may be set and the maximum current of the direct current electrical output thereby determined.

The secondary circuit of the ferroresonant transformer may further include a compensating winding which is wound on the primary core section and which is electrically connected in series opposition to the secondary winding such that voltage fluctuations on the primary winding are compensated. The ferroresonant transformer further includes a resonant winding wound on the secondary core section and a capacitance which is connected in parallel with the resonant winding.

The current responsive means may comprise a saturable reactor which receives a control current from a control current supply such that the impedance of the reactor is controlled and the voltage drop across the primary winding of the ferroresonant transformer determined for each level of current flow through the primary circuit. An adjustable autotransformer connected to the input terminals and a rectifier connected to the autotransformer may be provided for supplying the control current to the saturable reactor.

The input terminal means may comprise three input terminals for connection to a three phase alternating current power source with the current responsive means comprising three means for reducing the potential supplied to the ferroresonant transformers. Ferroresonant transformers in a three phase system may comprise six ferroresonant transformers having six primary windings, three of which may be connected in delta configuration and three of which may be connected in wye configuration. The six ferroresonant transformers may further include six secondary circuits. Six rectifier circuits are connected in parallel to the outputs of the secondary circuits, whereby a substantially ripple free direct current output is provided.

Accordingly, it is an object of the present invention to provide a power supply which converts an alternating current electrical power signal into a current limited substantially ripple free output signal which maintains a constant voltage below a predetermined output current level and which drops in voltage when the output current exceeds said predetermined current level; to provide such a power supply in which the primary winding voltage for a ferroresonant transformer is controlled by a current dependent device; to provide such a power supply in which the current dependent device comprises a saturable reactor; and, to provide such a power supply which converts three phase alternating current electrical power to a current limited direct current output.

Other objects and advantages of the present invention will be apparent from the following description, the accompanying drawings and the appended claims.

Brief Description of the Drawings

FIG. 6B, illustrate schematically a three phase power supply embodying the present invention.

DETAILED DESCRIPTION OF THE INVENTION

The present invention relates to a power supply for providing a direct current output signal at a predetermined voltage level when the current drawn is less than a predetermined value. When the output current exceeds this predetermined value, the output voltage drops below the predetermined level such that the current output is limited. The present invention makes use of the unique properties of a ferroresonant transformer.

A transformer of conventional construction is generally designed to operate below the level at which the transformer core is saturated with magnetic flux. If sufficient voltage is applied across the primary winding of such a transformer to saturate the transformer core, however, subsequent changes in the voltage applied to the primary winding will have minimal effect on the voltage output of the transformer on the secondary winding. Voltage regulation of the output is thus improved with the corresponding disadvantage, however, that the current in the primary will approach that of the short circuit.

To overcome this problem a modified transformer, termed a ferroresonant transformer, was developed in which the flux in the portion of the core upon which the secondary winding is positioned saturates that area of the core while permitting the core section on which the primary winding is wound to operate below the magnetic saturation level.

Figure 1:
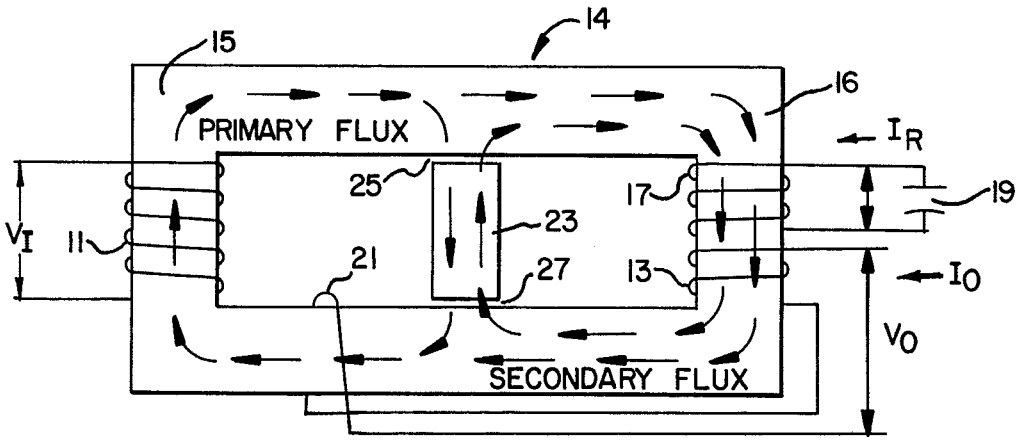
FIG. 1 is a somewhat diagrammatic view illustrating the construction of a conventional ferroresonant transformer device.

A typical prior art ferroresonant transformer construction is shown in FIG. 1. A primary winding 11 and a secondary winding 13 are wound on a core 14 which includes a primary core section 15 and a secondary core section 16. A resonant circuit is composed of a resonant winding 17 and a parallel connected capacitance 19. A compensation winding 21 is connected in series opposition to secondary winding 13.

Shunt section 23 connects primary core section 15 and secondary core section 16 and, provides a shunt path such that part of the primary flux bypasses the secondary coil section. Air gaps 25 and 27 limit the amount of magnetic flux which passes through the shunt core section 23. The primary flux which is not bypassed will flow through resonant winding 17 and secondary winding 13. This will cause a current $I_R$ to flow in the resonant winding 17, which will produce additional flux. The flux produced by resonant winding 17, at no load, will be in phase with and, therefore, arithematically added to the flux produced by the primary winding. Thus the total flux in the secondary core section may be increased to the magnetic saturation point. The primary portion of the transformer will operate as a conventional transformer, i.e., below the magnetic saturation point, while the secondary portion of the transformer will be held in saturation. The current in the primary winding, therefore, will not become excessive. A change in primary winding voltage $V_I$ will have a substantially reduced effect on output voltage $V_O$ as a result of the saturation of the secondary core section, however.

To improve the output voltage regulation even further, a compensating or bucking winding 21 is wound directly on the primary core section and is connected to the secondary winding 13 in series opposition. Compensating winding 21 will typically have relatively few turns. If the input voltage $V_I$ should increase, the voltage across the secondary winding 13 will increase slightly as well, even though the secondary core section is in magnetic saturation. The voltage induced across the compensating winding 21 will also increase, however, by an amount proportional to the increase in the voltage $V_I$. It will be seen, therefore, that this increase in compensating winding voltage will tend to offset the increase in voltage across the secondary winding 13, with the result that the voltage $V_O$ will be held at a substantially constant level.

When a load is placed across the secondary circuit output, the current flow $I_O$ will generate flux in the secondary core section which will oppose and tend to cancel the flux generated by the primary and resonant windings. As with a conventional transformer, the current in the primary winding 11 of a ferroresonant transformer will then increase to offset this reduction in flux density. As long as the total flux is sufficient to hold the secondary core section in saturation, the output voltage $V_O$ will remain relatively constant. As soon as the total flux in the secondary core section is reduced to the point where this section is no longer in saturation, the output voltage will drop rapidly. Beyond a critical output current level, therefore, further loading of the secondary circuit will increase the output current level only slightly while reducing the output voltage substantially. Thus, the ferroresonant transformer has an inherent current limiting capability.

Figure 2:
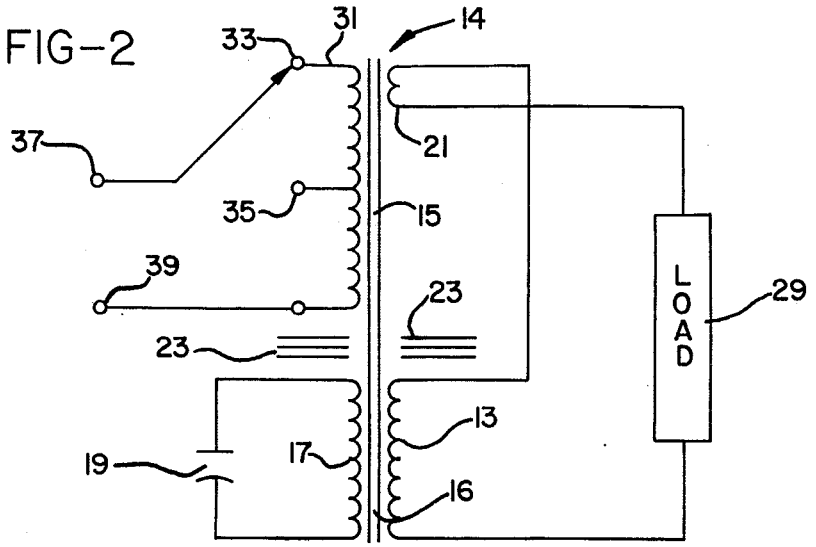
FIG. 2 is an electrical schematic illustrating a prior art power supply capable of operating on two input voltages.

Reference is now made to FIG. 2 illustrating a prior art power supply in which a ferroresonant transformer was used to take advantage of its constant output voltage characteristic. The circuit shown in FIG. 2 was used as a power supply for a battery charging circuit. The ferroresonant transformer, illustrated schematically in FIG. 2, has its component elements numbered to correspond with those of the transformer in FIG. 1. The load 29 may include a rectifier circuit for rectifying the regulated alternating current output prior to applying this output to the battery being charged. The primary winding 31 includes taps 33 and 35 which permit the primary flux generated by winding 31 to be adjusted.

Figure 3:
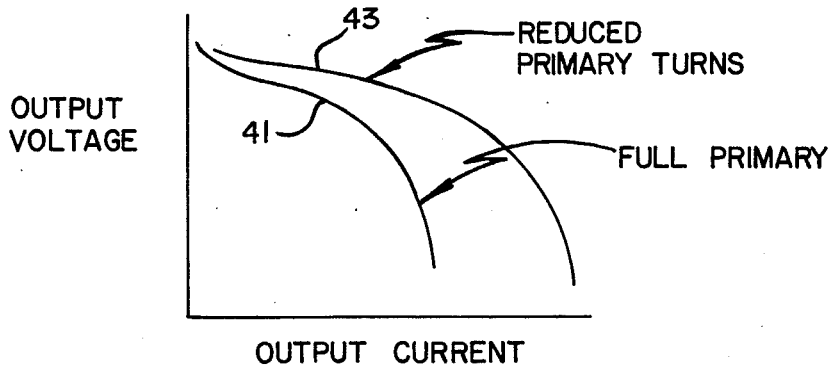
PRIOR ART FIG-3
FIG. 3 is a graph illustrating the operating characteristics of the device shown in FIG. 2.

FIG. 3 illustrates the output characteristics of the circuit of FIG. 2. Curve 41 shows the voltage/current characteristic when all the turns of the primary winding are connected to the power source. Curve 43, on the other hand, illustrates the operating characteristics when a primary winding is tapped to reduce the number of turns in the primary. As seen in FIG. 3, when the primary winding is tapped, primary flux will be significantly greater and the secondary core section will drop out of saturation less quickly. Although reduced maximum current output is provided when the circuit is connected with all of the primary turns energized, the voltage output is not sufficiently constant for many purposes. In fact, even the noload output voltages for the two connective arrangements will not necessarily be equal.

Figure 4:
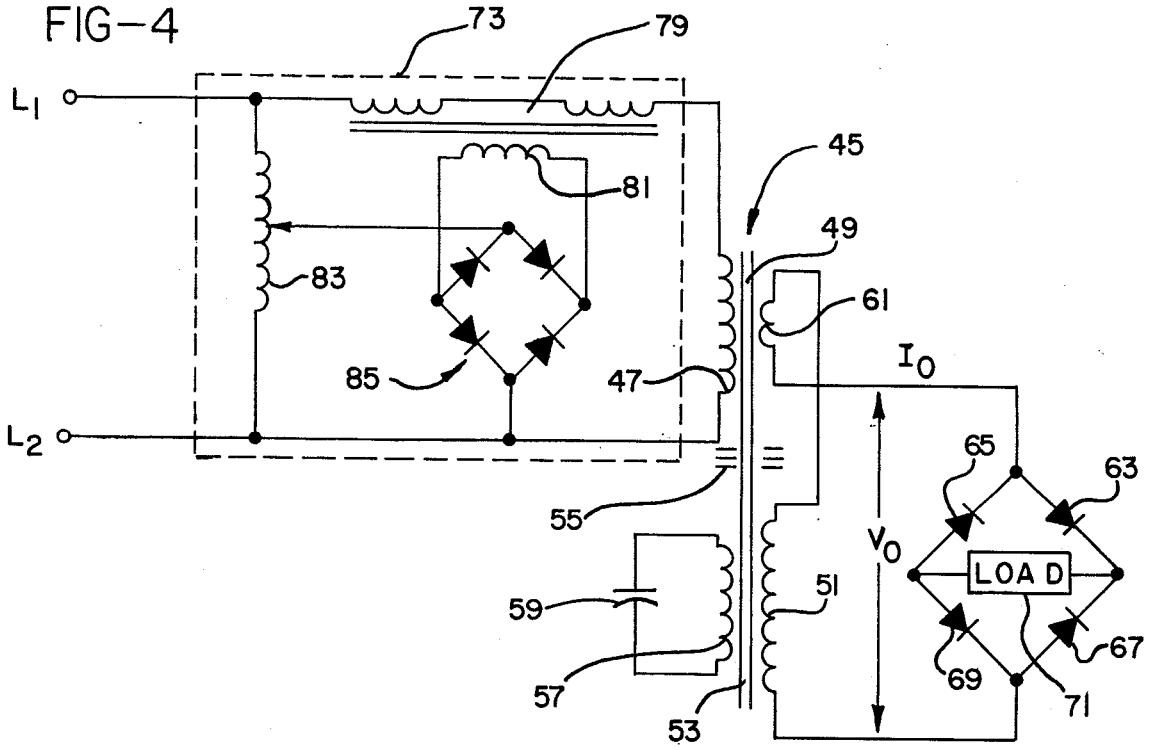
FIG. 4 is a schematic illustrating a single phase power supply embodying the present invention.

Reference is now made to FIG. 4 in which a single phase circuit embodying the present invention is illustrated. The circuit of FIG. 4 provides a voltage regulated current limited output, with the current limiting being variable over a substantial range of maximum output currents. An alternating current electrical power signal is supplied to input terminals $L_1$ and $L_2$. A ferroresonant transformer means 45, having a primary circuit including primary winding 47 wound on a primary core section 49 and having a secondary circuit including a secondary winding 51 wound on a secondary core section 53 is provided. The primary and secondary core sections are connected by a shunt section 55 which provides partial flux linkage between the primary and secondary core sections. As discussed above, the ferroresonant transformer means 45 will provide a substantially constant output voltage $V_O$ on its secondary circuit when the voltage on the primary winding 47 is sufficient to maintain the secondary core section 53 in saturation. A resonant winding 57 is also wound on core section 53. A capacitance 59 is connected across winding 57. The transformer secondary circuit also includes compensating winding 61 which is connected in series opposition to secondary winding 51.

Diodes 63, 65, 67 and 69 are connected in a bridge circuit such that load 71 is provided with a full wave rectified direct current electrical power signal. A current responsive means 73, connected between the input terminals $L_1$ and $L_2$ and the primary circuit of the ferroresonant transformer means 45, reduces the voltage supplied to the primary winding 47 of the transformer 45 in dependence upon the current through the winding 47.

As explained above, the increase in current in the primary winding 47 is a function of the increase in output current $I_O$. The current responsive means 73 includes a means for adjusting the amount by which the voltage to the primary coil 47 is reduced such that the current level in the secondary circuit, which is sufficient to prevent the secondary core section from being held in saturation, may be set. The current output level of the direct current electrical power signal is thereby limited to a predetermined maximum level and this limiting may be adjusted as illustrated in FIG. 5.

Figure 5:
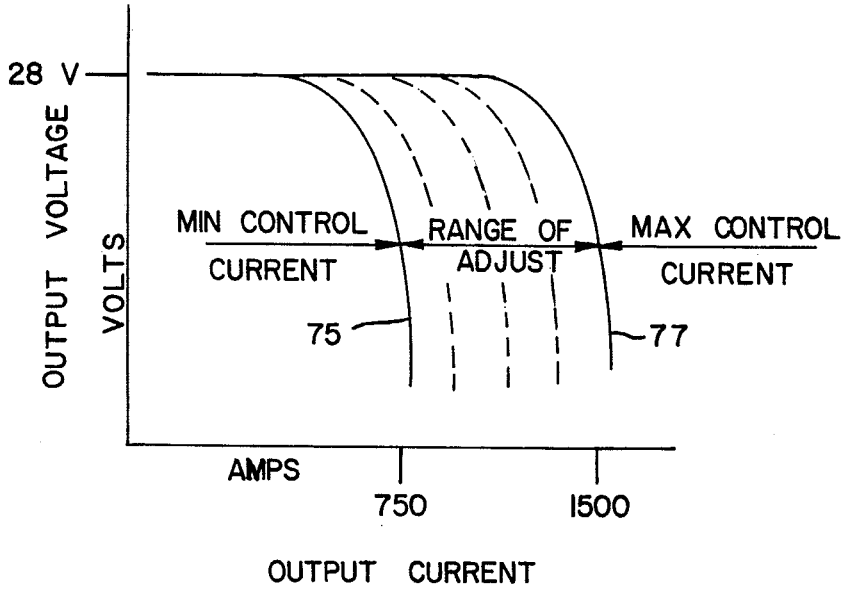
FIG. 5 illustrates the operating characteristics of the device of FIG. 4.

FIG. 5 illustrates the output characteristics of a power supply produced in accordance with the present invention. A family of output voltage/current curves indicated in dashed lines, lies between curves 75 and 77, which curves illustrate the maximum and minimum current limiting which may be set by the current responsive means 73.

Referring again to FIG 4, it can be seen that the current responsive means 73 includes a saturable reactor 79 of conventional design. The impedance of such a device is a function of the control current supplied to a control winding. The larger the control current supplied, the greater flux density which will be generated in the reactor core and, consequently, the lower the effective impedance of the reactor will become. Control winding 81 is provided with a variable control current supply including auto transformer 83 and diode bridge 85. The current flow through control coil 81 will be a function of the setting of the autotransformer 83.

Figure 6A:
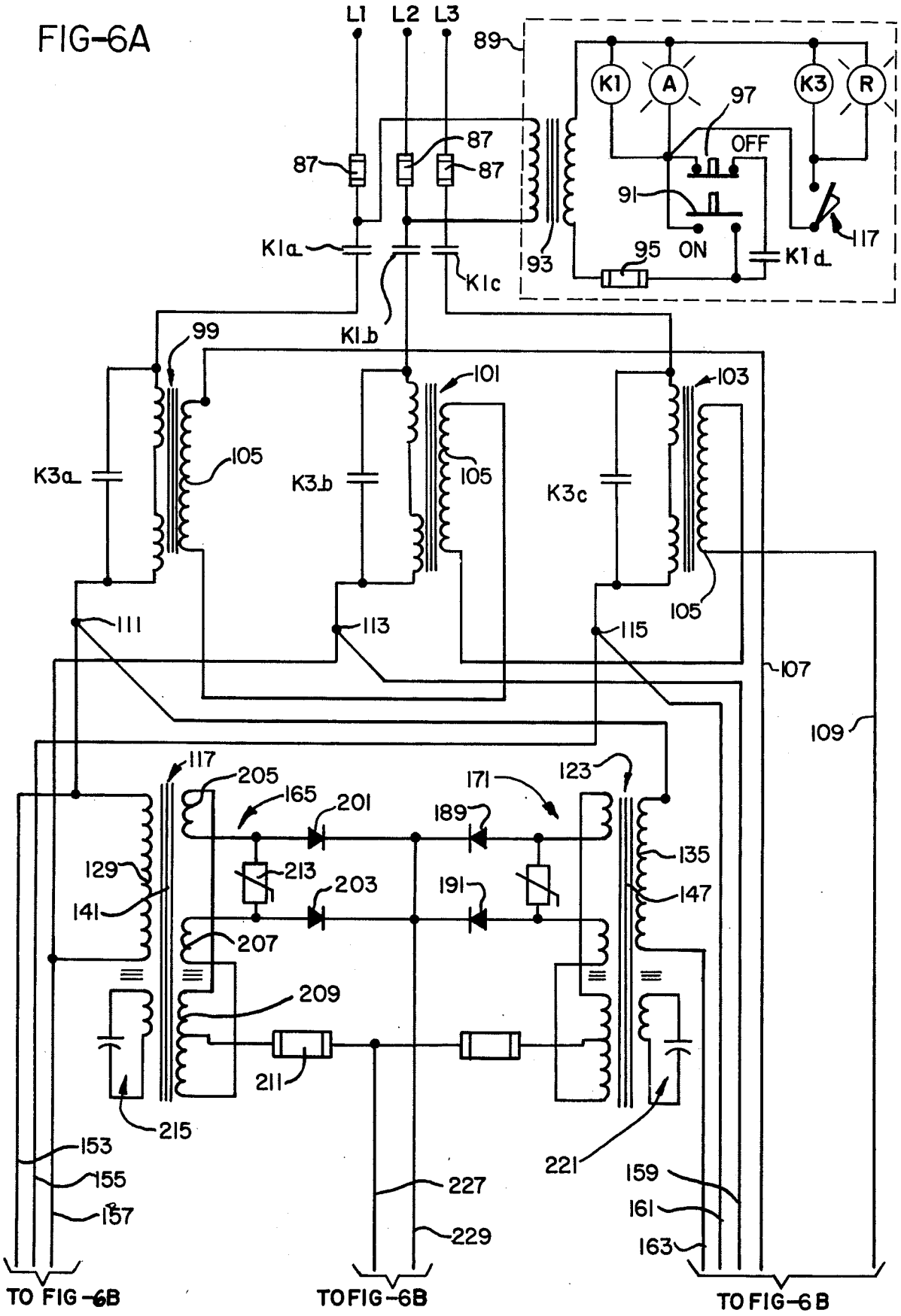
FIGS. 6A and 6B, when assembled with FIG. 6A positioned above
Figure 6B:
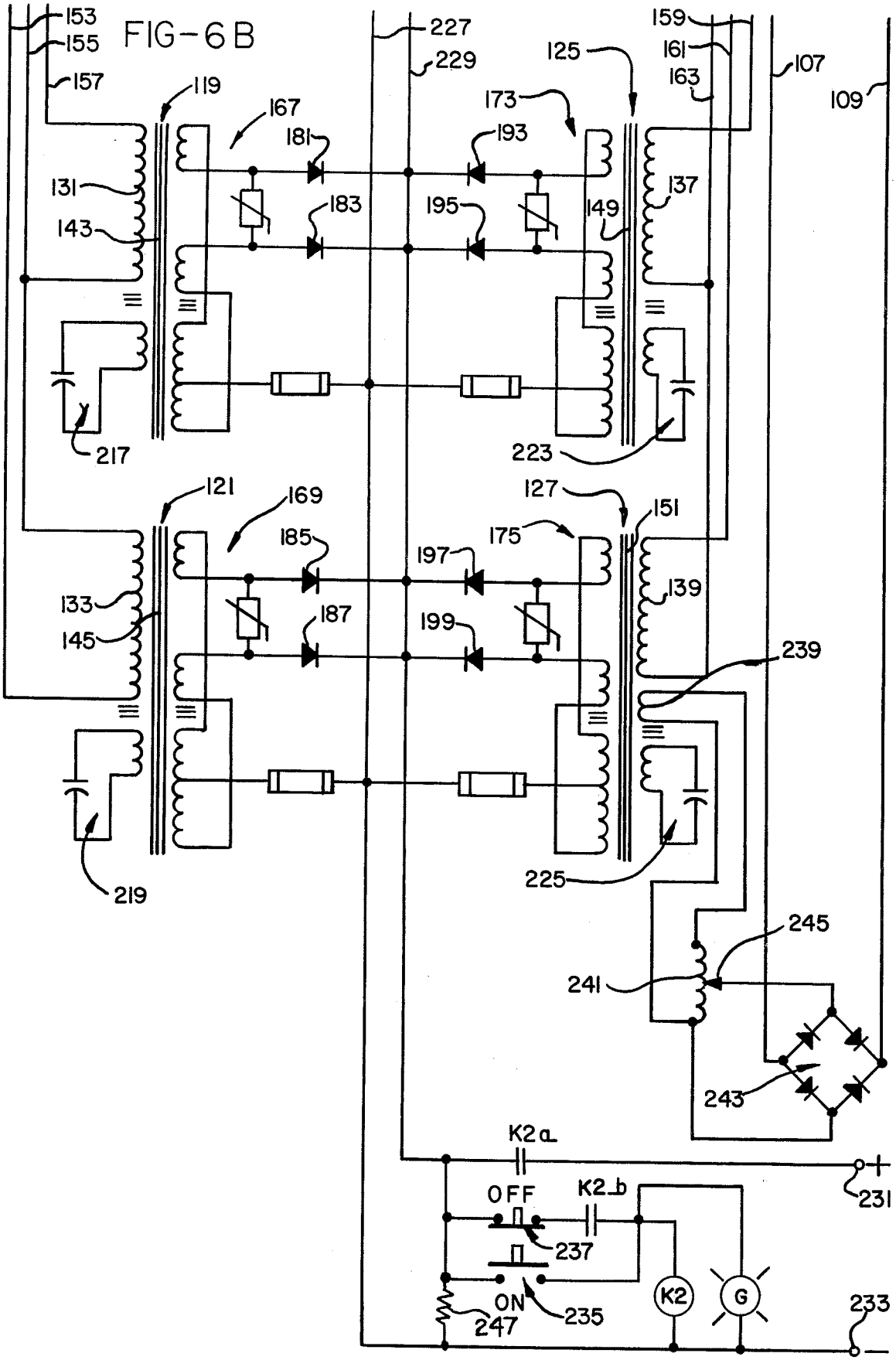

Reference is now made to FIGS. 6A and 6B which, when combined with FIG. 6A positioned above FIG. 6B, illustrate a three phase embodiment of the present invention. Three phase alternating current electrical power is provided at terminals L1, L2 and L3. Fuses 87 are placed in series in each line to protect the power supply against overload. A control circuit 89 controls the application of power to the power supply. ON switch 91, when closed, energizes relay coil K1 via transformer 93 and fuse 95. Transformer K1 then locks the coil in through OFF switch 97 and normally open contacts **K1*d*. The coil of relay K1 will remain energized until switch 97** is opened.

When coil K1 is energized, normally open contacts **K1*a*, K1*b* and K1*c* will close, applying power to first, second and third saturable reactors 99, 101, and 103, respectively. Each saturable reactor includes a control winding 105 and the effective impedance of the saturable reactors is controlled by the current through coils 105, which coils are connected in series to lines 107 and 109. First, second and third saturable reactor output terminals 111, 113, and 115, respectively, received reduced electrical potentials from the saturable reactors. A limit switch 117, when closed, will energize relay coil K3, causing normally open contacts K3*a*, K3*b* and K3*c* to close and effectively shunting saturable reactors 99, 101 and 103. Operation of switch 117** will be described more completely below.

Ferroresonant transformers 117, 119, 121, 123, 125 and 127 are provided, with each such transformer magnetically isolated from the others. First, second, third, fourth, fifth and sixth ferroresonant transformer primary windings 129, 131, 133, 135, 137 and 139, respectively, are wound on their respective ferroresonant transformer cores 141, 143, 145, 147, 149, and 151.

Lines 153, 155, and 157 provide a means for connecting the first, second and third ferroresonant transformer primary windings 129, 131 and 133 in delta electrical connection with respect to reactor output terminals 111, 113 and 115. Lines 159, 161, and 163 provide a means for connecting the fourth, fifth, and sixth ferroresonant transformer primary windings 135, 137 and 139 in wye electrical connection to the first, second and third saturable reactor output terminals 111, 113 and 115. First, second, third, fourth, fifth and sixth ferroresonant transformer secondary circuits 165, 167, 169, 171, 173 and 175, respectively, are each connected to a rectifier circuit consisting of two diodes.

Diodes 201 and 203 are connected through compensating windings 205 and 207 to center tapped secondary winding 209. Fuse 211 protects the secondary circuit of ferroresonant transformer 117. Surge suppressor 213, which may consist of a metal oxide varister, is connected across the anodes of diodes 201 and 203 to provide diode protection. The center tapped secondary winding configuration provides for full wave rectification of the transformer output. The secondary circuits of ferroresonant transformers 119, 121, 123, 125, and 127 are similarly connected.

Resonant circuits 215, 217, 219, 221, 223 and 225 enhance the operation of their respective ferroresonant transformers. Lines 227 and 229 provide a means for connecting the rectifier circuits in parallel such that a constant potential current limited direct current output signal may be obtained and supplied to output terminals 231 and 233.

Relay K2 is energized by closing ON switch 235. This results in relay K2 being energized and normally opened contacts K2*a* and K2*b* being closed. Relay K2 locks itself in through contacts K2*b* and contacts K2*a* apply power from line 229 to output terminal 231. If it is desired to remove power from the output terminals 231 and 233, contacts K2*a* may be opened by deenergizing coil K2 by actuating OFF switch 237.

Ferroresonant transformer 127 additionally has control current supply windings 239 wound on its primary core section. Windings 239, together with autotransformer 241 and diode bridge 243, provide control current to windings 105 via lines 107 and 109. The effective impedance of reactors 99, 101, and 103 is set by adjusting sliding contact 245 on autotransformer 241. Limit switch 117 is mechanically linked the adjustment knob for sliding contact 245 so that when the knob is rotated to provide for maximum output current, the coil of relay K3 is energized, closing contacts K3*a*, K3*b*, and K3*c*. Saturable reactors 99, 101, and 103, are thereby completely shunted with the result that the maximum current will be permitted to flow in the secondary circuits of the ferroresonant transformer. Resistor 247 is connected across the output terminals to provide a minimum load at all times, thus preventing a zero load surge condition.

By using supply windings 239 to provide the control current to saturable reactors 99, 101, and 103, the current limiting action of the circuit will be accentuated. As the circuit begins to go into a current limiting mode, the voltage applied to the primary windings 139 of transformer 127 will be reduced. This will result in the voltage on windings 239 being reduced and the control current supplied to the saturable reactors will therefore also be reduced. The impedance of the reactors will therefore increase with the net result that a further reduction in primary winding voltage will occur. A regenerative current limiting action will occur and, consequently, the current limiting of the device will be enhanced.

The descriptions of ferroresonant transformer devices embodying the present invention have included reference to the predetermined voltage level output signals which are provided when the current level of the output signal is less than a predetermined value. It should be understood that in actual operation, this predetermined voltage level will not remain absolutely constant over the normal operating range of such a device, but will vary slightly depending upon a number of factors, including the output current level and the operating temperature of the device. Devices constructed according to the present invention will generally have a regulated output voltage level which will be held within a ±%2 range of a nominal level, when less than the predetermined current level is drawn by a load.

After the current limiting action of the device of the present invention is initiated, an additional current may be drawn, since the voltage/current characteristic curves of the device do not become vertical as seen in FIG. 5. In one power supply device of the present invention, an additional current of 150 amps was permitted to be drawn after current limiting was initiated at 1000 amps. With the saturable reactors shunted, current limiting began at 1400 amps, with a maximum current of 1750 amps being drawn.

While the forms of apparatus herein described constitute preferred embodiments of the present invention it is to be understood that the invention is not limited to these precise forms of apparatus and that changes may be made therein without departing from the scope of the invention.

What is claimed is:

1. A power supply for converting an alternating current electrical power signal to an output electrical power signal, said power supply maintaining the voltage of said output signal at a predetermined level when the current level of said output signal is less than a predetermined value and reducing the voltage of said output signal below said predetermined level when said output signal current level exceeds said predetermined value such that the current level of said output signal is limited, comprising:

ferroresonant transformer means, having a primary circuit including a primary winding wound on a primary core section and having a secondary circuit including a secondary winding wound on a secondary core section, said primary and secondary core sections being connected by a shunt section providing partial flux linkage between said primary and secondary core sections, said ferroresonant transformer means providing substantially constant output signal voltage on said secondary circuit when the voltage on said primary winding is sufficient to maintain said secondary core section in saturation, input terminal means for connection to an alternating current power source; and saturable reactor means, connected between said input terminal means and said primary circuit of said ferroresonant transformer means, for reducing the voltage supplied to said primary winding of said ferroresonant transformer means in dependence upon the current therethrough, said saturable means including variable control current supply means for providing a control current to said saturable reactor means such that the impedance of said saturable reactor means may thereby be controlled and the voltage drop across said primary winding determined for each level of current flow through said primary circuit, whereby the current level in said secondary circuit which is sufficient to prevent said secondary core section from being held in saturation may be set and the current of said output electrical power signal thereby limited.

2. The power supply of claim 1, further comprising rectifier means, connected to said secondary circuit of said ferroresonant transformer means, for rectifying the output of said ferroresonant transformer means and providing a direct current electrical power signal.

3. The power supply of claim 2 in which said secondary circuit further comprises a compensating winding wound on said primary core section and electrically connected in series opposition to said secondary winding whereby voltage fluctuations on said primary winding are compensated.

4. The power supply of claim 3 in which said ferroresonant transformer means further comprises a resonant winding wound on said secondary core section and a capacitance connected across said resonant winding.

5. The power supply of claim 1 in which said variable control current supply means comprises:

an adjustable autotransformer, connected to said input terminal means, for supplying a reduced alternating current signal, and rectifier means, connected to said autotransformer means, for rectifying said reduced alternating current signal and providing the rectified signal to said saturable reactor means.

6. The power supply of claim 2 in which said input terminal means comprises three input terminals for connection to a three phase alternating current power source, and in which said saturable reactor means comprises three means for reducing the potential supplied to said ferroresonant transformer means, each of said means for reducing the potential supplied to said ferroresonant transformer means being connected to a separate one of said three input terminals.

7. The power supply of claim 6 in which said ferroresonant transformer means comprises six primary windings, three of said primary windings being connected in delta configuration and three of said primary windings being connected in wye configuration.

8. The power supply of claim 6 in which said ferroresonant transformer means further comprises six secondary circuits, and in which said rectifier means comprises six rectifier circuits, one of said rectifier circuits connected to each of said secondary circuits, and further comprising means connecting said six rectifier circuits in parallel whereby a substantially ripple-free, direct current output is provided.

9. A single phase, direct current power supply for converting an unregulated alternating current signal to a direct current signal which remains substantially constant in voltage below a predetermined current level and above said predetermined current level drops in voltage substantially comprising:

saturable reactor means, connected to a source of unregulated alternating current power and having a control winding, for providing adjustable reactance, ferroresonant transformer means having a primary winding connected to said saturable reactor means, a secondary circuit, including a secondary winding and a compensating winding connected in series opposition, and a resonant circuit including a resonant winding and a parallel connected capacitance said ferroresonant transformer means providing a constant voltage output on said secondary circuit when the current in said secondary circuit is less than said predetermined current level, said predetermined current level being dependant upon the voltage across said primary winding, rectifier means, connected in series with said secondary circuit, for rectifying said constant voltage output and providing said direct current signal, and control current supply means for providing control current to said control winding of said saturable reactor means, thereby adjusting the impedance of said saturable reactor means and controlling the voltage drop across said primary winding whereby said predetermined current level is set.

10. The power supply of claim 9 in which said control current supply means comprises:

autotransformer means, connected to said source of alternating current power, for providing a reduced alternating current signal, and rectifier means, connected to said autotransformer means, for receiving said reduced potential alternating current signal and for providing a rectified control signal to said control winding of said saturable reactor.

11. A power supply circuit for receiving three-phase alternating electrical power at three input terminals and providing a substantially constant potential, current limited, direct current output signal at a pair of output terminals, the maximum output current which may be drawn being adjustable, comprising:

first, second and third saturable reactor means each connected in series with one of said three input terminals and providing reduced electrical potentials to first, second and third reactor output terminals, respectively, said first, second and third saturable reactor means each including a control winding and means for supplying a control signal to each of said control windings, whereby the reactances of said saturable reactor means are controlled, first, second, third, fourth, fifth and sixth ferroresonant transformer primary windings wound on first, second, third, fourth, fifth and sixth ferroresonant transformer cores, respectively, means for connecting said first, second, and third ferroresonant transformer primary windings in delta electrical connection to said first, second and third saturable reactor output terminals, means for connecting said fourth, fifth and sixth ferroresonant transformer primary windings in wye electrical connection to said first, second and third saturable reactor output terminals, first, second, third, fourth, fifth and sixth ferroresonant transformer secondary circuit, wound on said first, second, third, fourth, fifth and sixth ferroresonant transformer cores, respectively, first, second, third, fourth, fifth and sixth ferroresonant transformer resonant circuits, each resonant circuit associated with a respective one of said transformer cores, first, second, third, fourth, fifth and sixth rectifier circuits electrically connected to said first, second, third, fourth, fifth and sixth ferroresonant transformer secondary circuits, respectively, and means for connecting said first, second, third, fourth, fifth and sixth rectifier circuits in parallel, whereby a constant potential, current limited, direct current output signal is provided, said maximum output current being dependent upon the voltage provided across said ferroresonant primary windings.

12. The power supply of claim 11 further comprising means for electrically shunting each of said first, second and third saturable reactor means, such that the voltage across said ferroresonant primary windings is not reduced and maximum current is available at said power supply output.

13. The power supply circuit of claim 11 in which said means for supplying a control signal to each of said control windings comprising:

control current winding means wound on one of said first, second, third, fourth, fifth, or sixth ferroresonant transformer cores and fully flux linked to the primary winding on the core, and rectifier means connected to said control current winding means for supplying the control signal to each of said control windings on said saturable reactor means, whereby an initial reduction in voltage on the primary windings will reduce the control current supplied to said saturable reactor means, thereby increasing the impedance of said saturable reactor means further, such that current limiting by said power supply circuit is enhanced.

* * * * *